United States Patent [19]

Heeren

[11] Patent Number: 4,508,168

[45] Date of Patent: Apr. 2, 1985

[54] RF APPLICATOR FOR IN SITU HEATING

[75] Inventor: Vernon L. Heeren, Wayland, Mass.

[73] Assignee: Raytheon Company, Lexington, Mass.

[21] Appl. No.: 323,212

[22] Filed: Nov. 20, 1981

Related U.S. Application Data

[63] Continuation of Ser. No. 164,723, Jun. 30, 1980, abandoned.

[51] Int. Cl.[3] ..... E21B 43/25

[52] U.S. Cl. ..... 166/248; 166/65 R

[58] Field of Search ..... 166/60, 65 R, 248; 219/10.55 R, 10.55 D, 10.55 F

[56] References Cited

U.S. PATENT DOCUMENTS

| | | | |
|---|---|---|---|
| 4,140,179 | 2/1979 | Kasevich et al. | 166/65 R |
| 4,196,329 | 4/1980 | Rowland | 166/248 |
| 4,207,452 | 6/1980 | Arai | 219/10.55 H |
| 4,265,307 | 5/1981 | Elkins | 166/248 |

*Primary Examiner*—William F. Pate, III

*Attorney, Agent, or Firm*—Walter F. Dawson; Richard M. Sharkansky; Joseph D. Pannone

[57] ABSTRACT

A coaxially fed applicator for in situ RF heating of subsurface bodies with a coaxial choke structure for reducing outer conductor RF currents adjacent the radiator. The outer conductor of the coaxial transmission line supplying RF energy to the radiator terminates in a coaxial structure comprising a section of coaxial line extending toward the RF radiator from the termination for a distance approaching a quarter wavelength at the RF frequency and a coaxial stub extending back along the coaxial line outer conductor from the termination for a distance less than a quarter wavelength at said frequency. The central conductor of the coaxial transmission line is connected to an enlarged coaxial structure approximately a quarter of a wavelength long in a region beyond the end of the outer conductor coaxial choking structure.

19 Claims, 6 Drawing Figures

RF APPLICATOR FOR IN SITU HEATING

CROSS-REFERENCE TO RELATED CASES

This is a continuation of application Ser. No. 164,723, filed June 30, 1980, abandoned.

BACKGROUND OF THE INVENTION

Structures for supplying RF energy to subsurface formations have been proposed such as those disclosed in U.S. Pat. No. 4,140,179 wherein a coaxial line extending through an outer casing terminates in a dipole arrangement in a body of oil shale. However, in such structures, portions of the energy were lost due to RF currents flowing back up the bore hole on the outside of the coaxial line. Thus, the heating of the subsurface body occurred partly above the region where the heating was desired. The dipole arrangement was such that the impedance match to the coaxial line and the radiation pattern were very sensitive to changes in the impedance of the shale due to changes in temperature and content of organic material.

SUMMARY OF THE INVENTION

In accordance with this invention, there is provided an RF applicator supplied with energy through a coaxial transmission line whose outer conductor terminates in a choking structure comprising an enlarged coaxial stub extending back along said outer conductor. More specifically, the applicator comprises an enlarged cylindrical member connected to the central conductor of the transmission line. The outer coductor of the coaxial transmission line is connected to a section of coaxially positioned conductive tubing having a substantially larger diameter than said outer conductor of said coaxial transmission line.

More specifically, this invention provides for a conductive sealing casing extending from the surface through loose material to consolidated overburden formations. A coaxial transmission line has a pipe acting as an outer conductor extending from the surface to an RF applicator which may be a radiator or a field defining electrode with said outer conductor being electrically connected to an enlarged conductor structure surrounding the outer coductor adjacent its lower end with the structure forming a reentrant region extending back along the outer conductor to reduce RF currents flowing back up the outer conductor from the RF applicator. An inner conductor of the coaxial transmission line extending from the surface into the subsurface formation to be heated is directly connected to an enlarged conductive electrode structure to form the primary electrode structure for coupling RF energy into the formation either as a radiator or as an electrode of a captive field structure.

This invention further provides for supplying fluid through the transmission line from the surface to the applicator. More specifically, the fluid may be high pressure liquid for injection into the formation being heated or may be a gaseous medium for improving the dielectric strength of the regions of the RF applicator or may be either liquid or gaseous medium for the purpose of flushing the products of pyrolysis collected below the RF applicator to the surface.

This invention further discloses a transmission line system for supplying power to a subsurface RF applicator through a variable impedance matching unit from a transmitter so that variations in the impedance of the oil shale formation due to variations in its temperature or due to variations in the frequency of the RF energy applied may be matched to the output impedance of the transmitter.

BRIEF DESCRIPTION OF THE DRAWINGS

Other and further objects and advantages of this invention will be apparent as the description thereof progresses, reference being had to the accompanying drawings wherein.

DESCRIPTION OF THE PREFERRED EMBODIMENT

Figure 1:
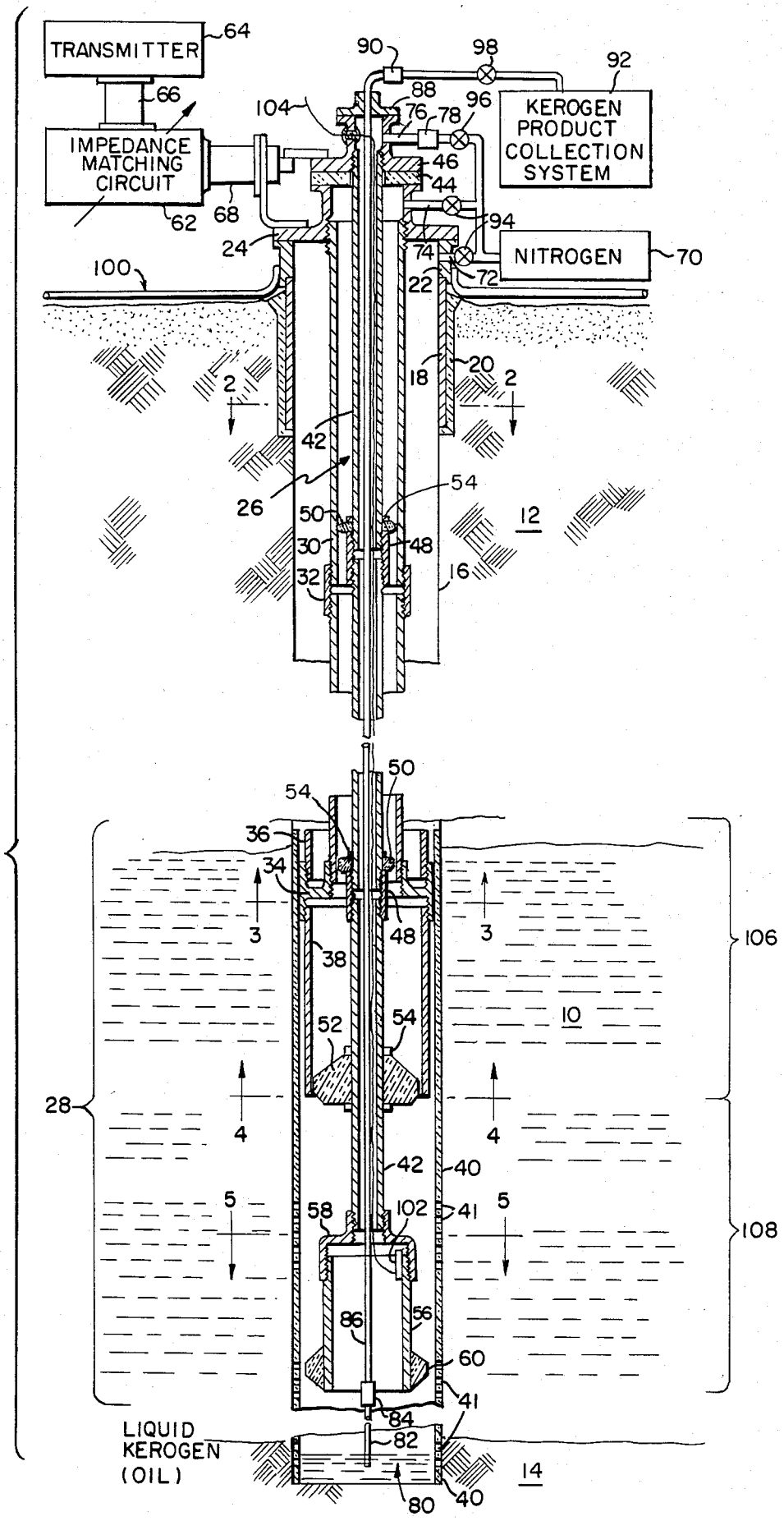
FIG. 1 illustrates a longitudinal sectional view of a subsurface RF applicator incorporated in a system embodying the invention.
Figure 2:
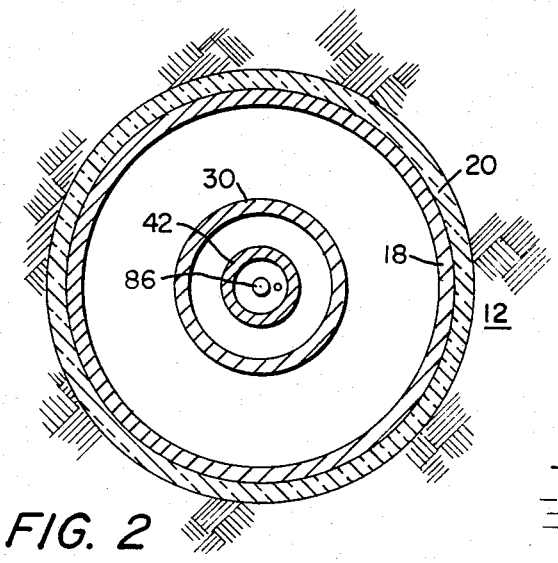
FIG. 2 is a transverse sectional view of the applicator transmission line of FIG. 1 taken along line 2—2 of FIG. 1.
Figure 3:
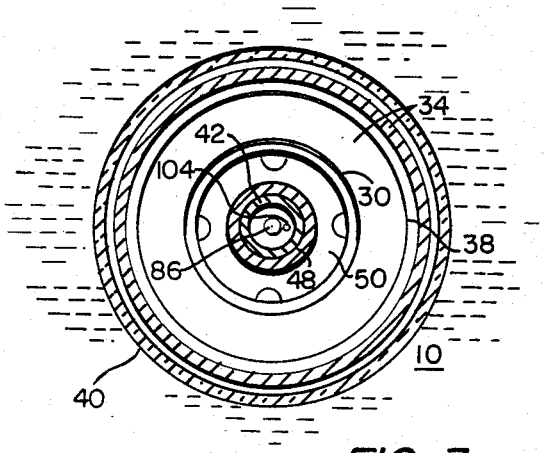
FIG. 3 is a transverse sectional view of the RF applicator choke structure of FIG. 1 taken along line 3—3 of FIG. 1.
Figure 4:
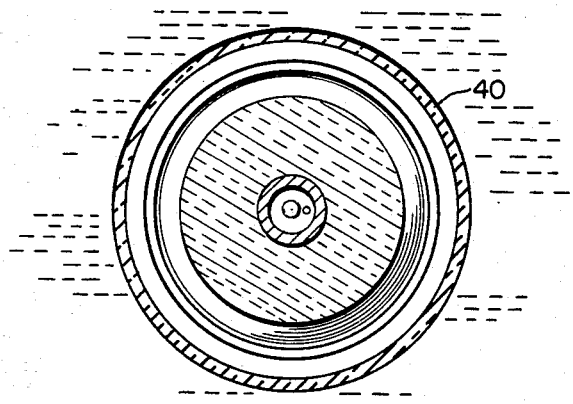
FIG. 4 is a transverse sectional view of the lower end of the choke structure of FIG. 3 taken along line 4—4 of FIG. 2.
Figure 5:
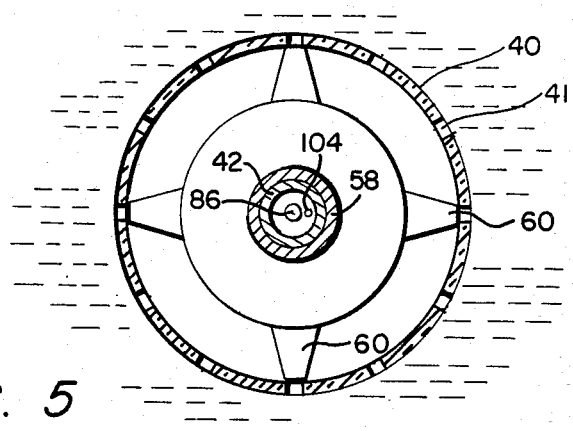
FIG. 5 is a transverse sectional view of the structure of FIG. 1 taken along line 5—5 of FIG. 1 illustrating the lower dipole of the radiating structure of FIG. 1.

Referring now to FIGS. 1-5 there is shown an oil shale formation 10 positioned beneath an overburden 12 and on top of a substrate 14. A bore hole 16 has been drilled from the surface through the overburden 12 and through the oil shale 10 into the substrate 14. Overburden 12 may be sedimentary material forming a substantially gas tight cap over the oil shale region 10.

In accordance with well-known practice a seal to the overburden 12 is formed by a steel casing 18 extending from above the surface downwardly in bore hole 16 to a point beneath the loose surface material and is sealed to the walls of the bore hole by concrete region 20 surrounding steel casing 18. While any desired bore hole size can be used dependent on the size of the RF applicator to be used, the example illustrated herein may have a steel casing 18 whose inner diameter is a standard 18 inches. A well head assembly comprising a flanged bushing 22 and a cap 24 is attached to the top of the steel casing 18, for example, by welding. Such a structure is preferably used to enable pressure to be maintained in the bore hole 16 and to prevent contamination of the bore hole, for example, by ground water.

A coaxial transmission line 26 extends from the cap 24 through the overburden 12 to an RF applicator 28 positioned in the oil shale region 10. The transmission line 26 is preferably formed with an outer conductor 30 of steel pipe having, for example, an internal diameter of approximately 6 inches and a thickness of approximately a half inch. Several lengths of pipe 30 are joined together by threaded couplings 32 and the upper end of the upper length of pipe 30 is threaded into an aperture in cap 24 while the lower length of pipe 30 is threaded into an adaptor coupling structure 34 which provides an enlarged threaded coupling to a coaxial stub 36 extending back up the bore hole 16 for a distance of around an electrical eighth of a wavelength of the frequency band to be radiated into the formation 10 by radiator 28. A stub 38 of the same diameter as stub 36 also extends downwardly from adaptor 34 for a distance equal to approximately an electrical quarter wavelength of said frequency band. If desired, a ceramic sleeve 40 having perforations 41 may be placed in the formation 10 to prevent caving of said formation during the heating process.

Coaxial transmission line 26 hs an inner conductor 42 made, for example, of steel pipe lengths. The upper end of the upper pipe lengths is threaded into cap 46. A ceramic plate 44 which is attached to cap 24 spaces the inner conductor electrically from the outer conductor 30. Cap plate 46 is mounted on top of plate 44 and threaded to pipe 42 so that pressure may be maintained inside the outer conductor 30 of the coaxial transmission line 26. Several lengths of pipe 42 connected together by metal couplings 48 and spaced from the inner wall of outer conductor 30 by ceramic spacer 50 extend from cap 46 downwardly through outer conductor 30 to a point beyond the lower end of tubular stub 38. An enlarged ceramic spacer 52 surrounds the pipe 42 adjacent its lower end and the lower end of tubular stub 38 to space pipe 42 centrally within coaxial stub 38. Preferably, ceramic spacers 50 rest on top of couplings 48 so that they may slide easily on the pipe lengths before being screwed into the couplings. Enlarged spacer 52 is held in axial position by metal collars 54 welded to the bottom length of pipe 42.

An enlarged section of pipe 56 is threadably attached to the lower end of the bottom pipe 42 by an enlarging coupling adaptor 58 and the lower end o enlarged tubular member 56 has a ceramic spacer 60 attached to the outer surface thereof to space member 56 from the bore face 16. In the example disclosed herein using approximately 6-inch size for pipe 30, the diameter of pipe 42 is approximately 2 inches inside and $2\frac{3}{8}$ inches outside. This produces a characteristic impedance for the transmission from the surface to the RF applicator 28 of approximately 50 ohms. By choosing the interior diameter of the stubs 36 and 38 to be, for example, of 12.715 inches, the characteristic impedance of the coaxial line sections comprising pipe 42 and stub 38, may be approximately 100 ohms. The outer diameter of the tubular radiating member 56 may be selected to be $8\frac{5}{8}$ inches to produce a radiating surface which may be easily inserted into the well bore 16 through the previously installed steel casing 18. Preferably the size of tubing 56 should be as large as practicable to reduce the voltage gradient on the surface of the tubing 56 during the radiation of high RF power into the formation 10.

In accordance with this invention the region from the upper end of tubular member 36 to the lower end of tubular member 38 is made an odd number of quarter wavelengths effective in shale in the operating frequency band of the device and forms an impedance matching section 106. More specifically, the distance from the adaptor 34 to the lower end of tubular member 38 is made approximately a quarter wavelength effective in air at the operating frequency of the system. The section 106 of applicator 28 comprising stub 38 together with the portions of member 42 adjacent thereto, act as an impedance matching transformer which improves the impedance match between coaxial line 26 and the radiator section 108 of applicator 28. Section 106 also substantially reduces the current from the RF power that would flow back up the outside of pipe 30 from the lower end thereof until the power had been lost by radiation into overburden 12 or absorbed by loss in the surface of pipe 30. With the structure or this invention, however, the power loss by current flow along the outer surface of the pipe 30 is reduced very substantially so that it is only a few percent of the power transmitted down the transmission line 26.

In accordance with this invention it is to be noted that the dielectric constant and loss tangent, and hence impedance, of the formation 10 change with temperature as may be seen from U.S. Pat. No. 4,140,179. In accordance with this invention, the impedance of the radiating section 108 changes very little over a wide range of temperatures of formation 10. To compensate for any such temperature impedance variation, an impedance matching device 62 is provided at the surface which may provide an adjustable impedance to the transmission line 26. The adjustment of the impedance matching circuit may be achieved by measuring the effective power reflected from the applicator 28 back along the transmission line 26 to determine the standing wave ratio on the transmission line 26. Thus it may be seen that the radiating structure 108 may be excited to produce a radiation pattern directed primarily radially outward in the plane of the oil shale medium with the bulk of the power being confined to the medium. While the frequency may, for example, be varied between 1 and 10 megahertz for the dimensions given herein, the tubular member 56 is preferably a quarter wavelength long, effective in shale. The spacing between the upper end of tubing 56 and the lower end of tubing 38 is preferably a quarter wavelength long, effective in shale with a substantial air gap.

The lengths of the enlarged section 56 and the portion of the section 42, which together form a substantially half wave monopole radiator 108 depend on the frequency of the transmitter 64 and the effective radiation wavelength in the medium 10 as well as the radiation impedance of the medium. Good results have been achieved, for example, at 10 megahertz, if the total length of the radiator 108 had the enlarged radiating section 56 (represented by the portion thereof below cutting line 5—5 of FIG. 1) approximately a seventh of a wavelength in air, and the section of the monopole radiator 108 represented by the extension of the inner conductor 42 beyond the lower end of the cylinder 38 (the portion between cutting line 4—4 and cutting line 5—5 in FIG. 1) approximately a sixth of a wavelength in air. When the medium 10 has a substantial quantity of water therein, for example, when the medium is first being heated, the effective wavelength 108 will be somewhat greater than a half wavelength. However, as heating progresses and the water is either converted to steam or driven off, the dielectric constant in the medium drops and the effective wavelength increases. Operating the monopole radiator 108 with an effective electrical wavelength greater than one-half wavelength reduces and vertical directionality of the patterns. Therefore, radiator 28 preferably has dimensions which in wet shale, having a dielectric constant of, for example, 16 and in spent shale having a dielectric constant as low as 3, result in the radiating monopole 108 being approximately a half wavelength long. Thus, for example, for a transmitter frequency of 10 megahertz in which the free space wavelength is $3\times10^3$ centimeters or 30 meters which is 100 feet, the length of section 56 is chosen to be approximately 14 feet and the distance from the bottom of cylinder 38 to the top of casing 58 is chosen to be 16 feet.

In operation, the bulk of the power is radiated from the section 108 and the section 106 acts as a resonant impedance transformer. The stubs 36 and 38 act as a non-resonant or inductive choking structure whose length may be determined empirically to optimize the directive pattern in the horizontal direction as measured in the vertical plane. By varying the frequency, the pattern radiated can also be varied.

Transmitter 64 supplies variable frequency RF power to the impedance matching structure 62 through a coaxial line 66 and the impedance matching structure 62 supplies the RF power to the coaxial line 26 through a coaxial line 68 whose central conductor is connected to the cap 46 and whose outer conductor is connected to the cap 24.

Figure 6:
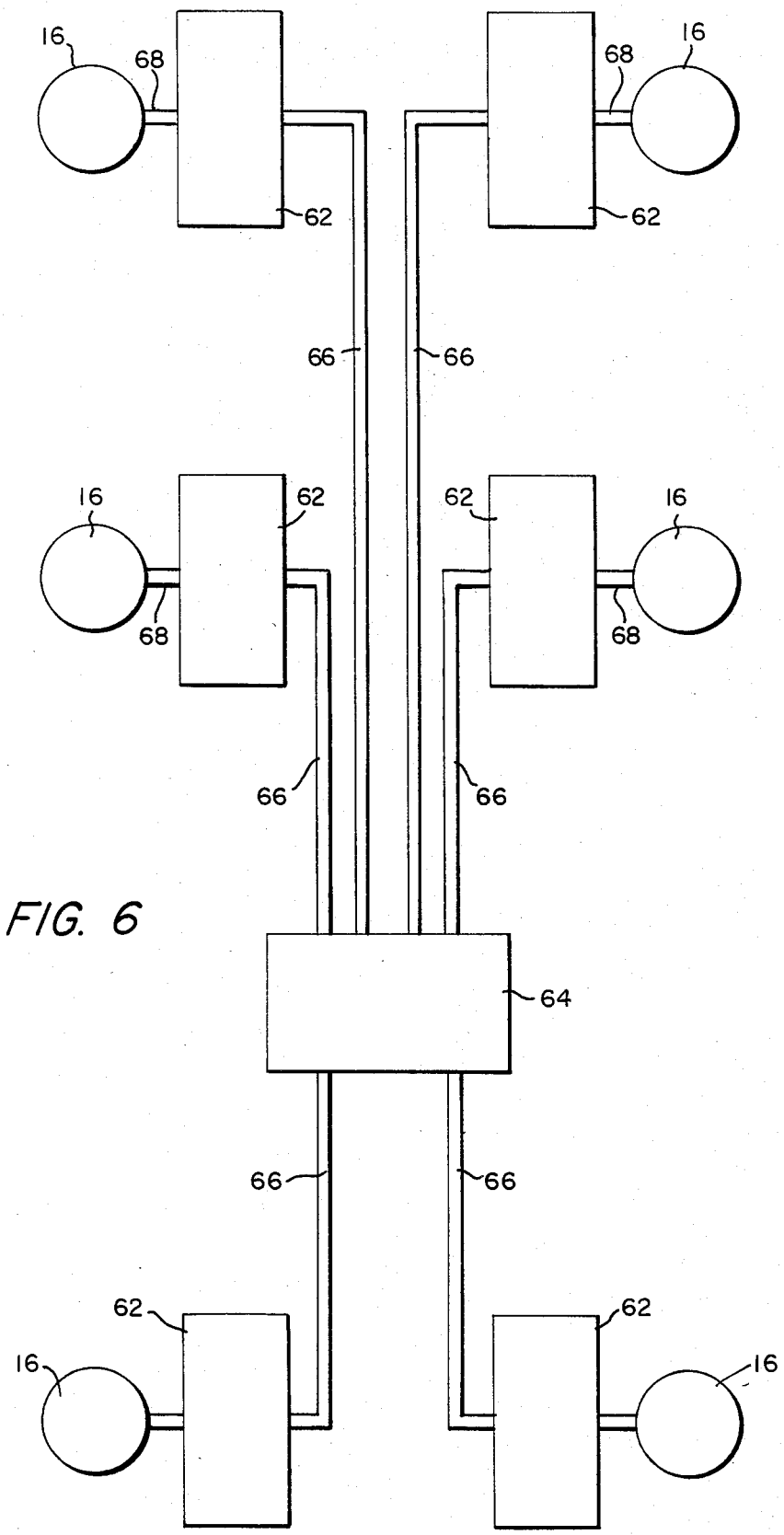
FIG. 6 is a plan view illustrating a power layout and control system for utilizing a plurality of the systems of FIG. 1.

As shown in FIG. 6, transmitter 64 preferably is located remotely from several sites 16 and transmission lines 66 extend distances up to in excess of 1,000 feet. Thus, one large transmitter installation can be used to feed sequentially different sites 16. It is, therefore, preferable that the standing wave ratio on the transmission lines 66 be maintained as close to unity as possible so that RF losses in the transmission line are minimized. In addition, it is also desirable that little or no power be fed back into the transmitter 64 to avoid damage to the transmitter equipment as well as to allow the transmitter equipment to be tuned for maximum RF power generating efficiency. Thus, the impedance matching circuits 62, which may use conventional inductors and capacitors, is adjusted in accordance with well-known practice to produce such impedance matching of the transmission lines 66.

While the radiator 56 may be sized for optimum radiation characteristic and/or power at a particular frequency, for example, by making the length of the element 56 an effective electrical quarter wavelength at that frequency in the bore 16, it is desirable that the frequency of transmitter 64 be variable to adjust for the different impedances or different formations and/or the different impedances of the formation encountered during different portions of the heating sequence. Such impedance matches may also be achieved by variation of the output impedance of impedance matching circuit 62 so that by means of a standing wave the proper impedance is reflected through the relatively short transmission line stub 68 and the transmission line 26 to the radiating structure in the formation 10.

The impedance matching structure 62 is preferably adjusted for the desired impedance match into the radiating structure 26 with the transmitter 64 at low power, and the impedance match to produce low standing wave ratio in transmission line 66 is then adjusted. However, it should be clearly understood that such impedance matching functions can be controlled in accordance with a preprogrammed schedule.

It has been found that good impedance match to oil shale formations can be obtained over a thirty percent frequency band without substantial loss in the efficiency of transferring RF power to the formation 10.

The transmission line 26 is preferably pressurized with an inert gas, such as nitrogen, from a source 70 through a pipe 72 tapped into bushing 22, through a pipe 74 tapped into cap 24 as well as to the interior of pipe 42 through a pipe 76 connected by a insulating coupling 78.

The source of nitrogen 70 may be of sufficient pressure to continuously bleed nitrogen into the pipes 42 and 30 as well as the casing 18 so that nitrogen flushes down the face of the bore 16 and through the region between the pipes 42 and 30. Preferably, the ceramic spacers have apertures in the peripheries thereof to allow the passage of the nitrogen. The nitrogen then presses against liquids 80 collected in the bottom of the bore 16 and forces them up through a producing tubing 82 which may be steel with a ceramic coupling 84 approximately at the lower end of the radiating cylinder 56. Ceramic coupling 84 isolates the tubing 82 which is essentially at ground potential from a tubing 86 extending upwardly through pipes 42 to the surface and through a cap 88 attached to the top of cap 46 and thence through an insulating coupling 90 to a collection tank 92 where the nitrogen can be recovered, if desired, and re-injected via the source 70 into the formation.

Such a circulation of nitrogen, in addition to aiding in production of kerogen products from the base of the bore 16, may serve to cool overheated portions of the transmission line and/or radiating structure so that high powers may be transmitted from the transmitter 64 into the oil shale body 10 without voltage breakdown at high voltage points in the structure.

In order to control the flow of gas from supply 70 to the various regions of the transmission line and radiator, pipes 72 and 74 contain valves 94. Pipe 76 contains a valve 96 on the grounded side of bushing 78 and the pipe from bushing 90 to the collection tank 92 contains a valve 98 so that by opening and closing the valves, gas from the well bore may be increased, held constant or decreased during various cycles of the production process. By maintaining an appropriate purging flow of nitrogen through the well bore 16 before and during application of RF power, danger of explosion in the region of the RF applicator may be minimized. Such an explosion could occur, for example, if oxygen, driven off from components of the formation or present after installation of the well transmission line, combined with hydrocarbons in gaseous form driven off from the formation when a corona discharge or arc at the RF applicator caused ignition of an explosive mixture. The length of the transmission line 26 should be sufficient to reach any desired region of the oil shale 10 and for thick beds of oil shale may be gradually changed by raising or lowering the transmission line 26. This, in turn, raises or lowers the radiator 28 to expose a different horizontal layer of the oil shale to the maximum intensity of the radiation.

RF breakdown is minimized by the use of the ceramic spacers 50, 52, 40 and 60 which maintain the various electrical conductors substantially concentric with each other and with the bore hole 16 so that impedance variations along the transmission line due to eccentricities which could otherwise occur between the inner and outer conductors of the coaxial line 26 are minimized. These eccentricities could cause standing wave ratios in excess of those contemplated thereby causing higher voltage nodes at points on the transmission line or in the RF radiator.

The edges of the insulators are preferably beveled to facilitate relative motion between the conductors during installation and a large insulating spacer 52 is positioned between the lower end of stub 38 and inner conductor pipe 42 since in this region a voltage maximum can occur. Such a voltage maximum is likely to increase as the standing wave ratio on the transmission line 26 increases so that at large power levels, corona breakdown might occur. Maximum power handling capability, in addition to being limited by voltage breakdown, is limited by the power dissipation of the transmission line and for the structure shown fabricated of conventional steel with surfaces coated with highly conductive material, such as copper, powers in excess of one megawatt may be transmitted through the transmission line 26 and the radiator 28 into the formation 10.

In the event that the RF applicator 28 is not sufficiently deep, that is, the overburden 12 is not sufficintly thick, some of the RF energy at high powers radiated into the formation 10 may appear at low intensity on the surface. In accordance with this invention, wires, for example steel cables 100, may be welded to cap 22 and stretched radially for several hundred feet to reflect such radiation back into the overburden thereby preventing radiation interference when frequencies of, for example, 10 megahertz or below are used. Generally, frequencies above 10 megahertz are sufficiently absorbed in most overburden formations and lower frequencies are absorbed in those cases where there is substantial moisture content in the overburden. The spacing between the radial wires can be any desired amount and branch wires from the radial wires may also be attached, if necessary. In addition, when more than one structure is placed in a given region, the wires can extend between adjacent structures.

As indicated previously in connection with U.S. Pat. No. 4,140,179, the impedance changes due to both the absorption of the microwave energy because of changes in conductivity and because of changes in the dielectric constant due to removal of that portion of the water which originally existed in the oil shale body. The temperature at which such water changes to steam and is produced out of the formation depends on the pressure maintained in the well bore. For example, if the valve 98 remains closed and the bore face having first been flushed with nitrogen is pressurized to 500 psi, the temperature in the oil shale 10 may be raised at the bore face to several hundred degrees fahrenheit with the water still remaining in liquid form in the pores of the oil shale body. Water on the order of 3 to 30 percent may be encountered and will absorb substantial amounts of the RF power.

In accordance with this invention the temperature in the bore face may be sensed, for example, by a thermocouple 102 of a type shown in U.S. Pat. No. 4,140,179, and as item 102 in FIG. 1, connected to the surface via a wire 104. When the temperature reaches, for example, 700° F., opening the valve 98 will cause the pressure in the bore face to produce steam from the water cooling the bore face to a temperature below 700° F. and preventing undesired hot spots at the surface of the formation 10.

While the coaxial line 26 has surfaces providing RF current flow which are large and hence low in current density for a given power level the coaxial lines 66 and 68 may be, for example, conventional conductive copper coaxial lines having, for example, an outer diameter of 3⅛ inches. Such lines may be run for several hundred yards from a central transmitter and preferably have the impedance matching structure 62 positioned close to the surface of the well bore 16. Thus, the impedance of the transmitter 64 may be substantially matched to the input impedance of the matching structure 62 to maintain a standing wave ratio in line 66, for example, below 1.5 whereas the transmission line 26 may have a standing wave ratio thereon of 1.5 to 5 depending on the matching required to optimize the radiation from radiator 28.

Referring now to FIG. 6, there is shown a plan view of a plurality of well bores 16 in a well field spaced apart by distances such as several hundred feet and connected via coax cabling through impedance matching structures 62 to a central transmitter 64 via coaxial lines 66. The RF power may be sequentially shifted in any desired pattern to different radiators in different well bores 16 from a single transmitter housing which may be in, for example, a control station. Signals fed from the impedance matching structures 62 to the control station may be used to monitor and/or adjust the frequency and impedance matching of the transmitter output to each of the wells.

This completes the description of the particular embodiment of the invention illustrated herein. However, many modifications thereof will be apparent to persons skilled in the art without departing from the spirit and scope of this invention. For example, parallel wire lines could be use to feed the structures in the wells, other frequencies could be used than those indicated and a wide variety of conductive materials could be used for the transmission lines and radiating structures in the wells. Accordingly, it is intended that this invention be not limited by the particular details of the embodiments illustrated herein accept as defined by the appended claims.

What is claimed is:

1. The method of producing organic products from a body of oil shale beneath an overburden comprising:

generating electrical energy in the frequency range between 100 kilohertz and 100 megahertz;

transmitting said energy via a first transmission line having a first characteristic impedance through a first impedance transformation structure to a second transmission line which has a second characteristic impedance and which extends through said overburden and which is coupled to a radiating structure through a second impedance transformation structure positioned in said body of oil shale and substantially impedance matched to said transmission line; and varying the impedance matching of said first impedance transformation structure to compensate for changes in temperature of said oil shale body.

2. The method of producing organic products from a body of oil shale beneath an overburden comprising:

generating electrical energy in the frequency range between 100 kilohertz and 100 megahertz;

transmitting said energy via a first transmission line having a first characteristic impedance through a variable impedance matching structure to a second transmission line having a sound characteristic impedance and extending through said overburden to couple said energy through an impedance matching structure to a radiating structure positioned in said body of oil shale; and varying the frequency of said energy to vary the pattern of said energy radiated into said body of oil shale.

3. The method of producing organic products from a body of oil shale beneath an overburden comprising:

generating electrical energy in the frequency range between 100 kilohertz and 100 megahertz;

transmitting said energy via a first transmission line having a first characteristic impedance through a variable impedance matching structure to a second transmission line having a second characteristic impedance ad extending through said overburden to couple said energy through an impedance matching structure to a radiating structure which is positioned in said body of oil shale; and varying the frequency of said energy to compensate for changes in the impedance of said oil shale body to said energy.

4. The method of producing organic products from a body of oil shale beneath an overburden comprising:

generating electrical energy in the frequency range between 100 Kilohertz and 100 megahertz;

transmitting said energy via a first transmission line having a first characteristic impedance through a variable impedance matching structure to a second transmission line having a second substantially different characteristic impedance from that of said first transmission line and extending through said overburden to couple said energy through an impedance matching structure to a radiating structure positioned in said body of oil shale;

varying the frequency of said energy to vary the pattern of said energy radiated into said body of oil shale; and adjusting said variable impedance matching structure to reduce the power on said first transmission line reflected from said second transmission line and/or said radiating structure.

5. The method of producing organic products from a body of oil shale beneath an overburden comprising:

generating electrical energy in the frequency range between 100 kilohertz and 100 megahertz;

transmitting said energy via a first transmission line having a first characteristic impedance through a variable impedance matching structure to a second transmission line having a second characteristic impedance and extending through said overburden to couple said energy through an impedance matching structure to a radiating structure positioned in said body of oil shale while sensing the reflected power on said second transmission line; and varying the impedance matching of said structure as a function of said reflected power.

6. A system for radiating energy into a subsurface body comprising:

a coaxial transmission line extending from the surface of said body to an RF applicator;

said coaxial transmission line comprising inner and outer cylindrical conductors and said inner conductor being attached to a cylindrical radiating element at a point below the lower end of said outer conductor, said outer conductor being attached to an impedance matching element having a first tubular member extending upwardly parallel to said outer conductor and a second tubular member extending downwardly parallel to said inner conductor;

the maximum diameter of said radiating element being substantially larger than the average diameter of the outer conductor of said transmission line; and the upper end of said first tubular member being displaced from the lower end of said second tubular member a length equal to an odd number of quarter wavelengths of the operating wavelength of said radiating energy system.

7. A radiating system comprising a coaxial transmission line having a radiating element connected to the inner conductor of said transmission line and a cylindrical conductive structure connected to the outer conductor of said transmission line, said conductive structure comprising:

a first upwardly extending tubular member coupled to the lower end of said outer conductor and extending parallel to said outer conductor and a second downwardly extending tubular member coupled to the lower end of said outer conductor and extending parallel to said inner conductor; and the diameter of said conductive structure being substantially greater than the average diameter of the inner surface of the outer conductor of said transmission line.

8. The system in accordance with claim 7 wherein the diameter of said radiating element is substantially greater than the diameter of said inner surface of said outer conductor.

9. The system in accordance with claim 7 wherein said inner conductor is hollow.

10. A system for transferring RF energy into a subsurface body comprising:

a coaxial transmission line extending from the surface of said body to an RF applicator;

said coaxial transmission line comprising inner and outer cylindrical conductors;

said inner conductor being attached to a cylindrical radiating element at a point below the lower end of said outer conductor and said outer conductor being attached to a conductive structure surrounding the end of said outer transmission line, said conductive structure having a first tubular member extending upwardly parallel to said outer conductor and a second tubular member extending downwardly parallel to said inner conductor;

the maximum diameter of said conductive structure being substantially greater than the average diameter of the inner conductive surface of said outer conductor of said coaxial transmission line; and means for supplying said transmission line with said RF energy.

11. A system for producing organic products from a body of oil shale beneath an overburden comprising:

means for generating electrical energy in the frequency range between 100 kilohertz and 100 megahertz;

means for transmitting said energy via a first transmission line having a first characteristic impedance through a variable impedance matching structure to a second transmission line having a second characteristic impedance;

said second transmission line extending through said overburden and being coupled to a radiating structure positioned in said body of oil shale through an impedance transition; and means for varying the frequency of said energy.

12. A system for radiating RF energy into a subsurface body comprising:

means for generating said RF energy;

a coaxial transmission line extending from the surface of said body to an RF applicator for supplying said applicator with said energy;

said coaxial transmission line comprising inner and outer cylindrical conductors;

said inner conductor being attached to a cylindrical radiating element extending below the lower end of said outer conductor; and the lower end of said outer conductor being attached to an impedance matching structure having a first tubular member extending upwardly parallel to said outer conductor and a second tubular member extending downwardly parallel to said inner conductor and having a maximum diameter which is substantially larger than the average diameter of the conductive inner surface of said outer conductor;

said radiating element attached to said inner conductor being disposed in said system a distance below the end of said conductive structure wherein said distance between the upper end of said radiating element and the lower end of said second tubular member is a quarter wavelength of the operating wavelength of said system.

13. A subsurface radiating system comprising a coaxial transmission line having a radiating element connected to the inner conductor of said transmission line and a coaxial impedance transformation structure connected to the outer conductor of said transmission line, said impedance transformation structure comprising a first tubular member coupled to the lower end of said outer conductor and extending upwardly parallel to said outer conductor and a second tubular member coupled to the lower end of said outer conductor and extending downwardly parallel to said inner conductor; and the second tubular member of said structure having a maximum diameter substantially greater than the average diameter of the inner conductive surface of said outer conductor.

14. The system in accordance with claim 13 wherein the diameter of said impedance transformation structure is substantially greater than the diameter of said radiating element.

15. The system in accordance with the claim 13 wherein said inner conductor is hollow.

16. The system in accordance with claim 13 wherein the outer diameters of an impedance transformation structure coupling said transmission line to said radiating structure are substantially greater than the diameter of said inner conductor.

17. The system in accordance with claim 16 wherein said inner conductor is hollow.

18. A system for producing organic products from a body of oil shale beneath an overburden comprising:

means for generating electrical energy in the frequency range between 100 kilohertz and 100 megahertz;

means for supplying said energy via a first coaxial transmission line having a first characteristic impedance through a variable impedance matching structure to a second coaxial transmission line having a substantially different characteristic impedance from that of said first transmission line;

said second transmission line extending through said overburden to supply said energy through an impedance matching structure to a radiating structure positioned in said body of oil shale;

said radiating structure comprising a radiating element connected to the inner conductor of said second transmission line;

said impedance matching structure comprising a first tubular member coupled to the lower end of an outer conductor of said second transmission line extending upwardly parallel to said outer conductor and a second tubular member coupled to the lower end of said outer conductor extending downwardly parallel to said inner conductor; and the diameter of said impedance matching structure being substantially greater than the average diameter of the outer conductor of said second transmission line.

19. The system in accordance with claim 18 wherein the diameter of said radiating element is substantially greater than the diameter of said inner conductor of said second transmission line, and the distance between the upper end of said radiating element and the lower end of said second tubular member is a quarter wavelength of the operating wavelength of said system.

* * * * *

UNITED STATES PATENT OFFICE

CERTIFICATE OF CORRECTION

Patent No. 4,508,168 Dated April 2, 1985

Inventor(s) Vernon L. Heeren

It is certified that error appears in the above-identified patent and that said Letters Patent are hereby corrected as shown below:

In the Specification:

Column 3, Line 9: Change "hs" to --has--.
Line 32: Change "o" to --of--.
Column 4, Line 57: Change "and" to --the-- and change "patterns" to --pattern--.
Column 8, Line 52: Change "sound" to --second--
Line 68: Change "ad" to --and--.

Signed and Sealed this

*Twenty-fourth* Day of *June 1986*

[SEAL]

*Attest:*

DONALD J. QUIGG

*Attesting Officer*

*Commissioner of Patents and Trademarks*